United States Patent [19]

Posner et al.

[11] Patent Number: 4,835,920

[45] Date of Patent: Jun. 6, 1989

[54] GUARDRAIL WINDOW ASSEMBLY WITH MOVABLE CROSSHEADER

[76] Inventors: Carole Posner, 10180 W. Bay Harbor Dr., Bay Harbor Island, Fla. 33154; Angelo S. Gasparri, 8551 NW. 18th Pl., Coral Springs, Fla. 33071

[21] Appl. No.: 226,998

[22] Filed: Aug. 1, 1988

[51] Int. Cl.[4] ..... E04B 1/04

[52] U.S. Cl. ..... 52/207; 52/64; 52/67; 52/632

[58] Field of Search ..... 52/64, 67, 632, 207

[56] References Cited

U.S. PATENT DOCUMENTS

| | | | |
|---|---|---|---|
| 3,052,291 | 9/1962 | Fellers | 52/207 |
| 4,731,961 | 3/1988 | Bona | 52/632 X |
| 4,735,023 | 4/1988 | Posner | 52/632 X |

*Primary Examiner*—David A. Scherbel
*Assistant Examiner*—Jerrold D. Johnson
*Attorney, Agent, or Firm*—Robert C. Kain, Jr.

[57] ABSTRACT

The guardrail window assembly includes a window sub-assembly movable between the floor and ceiling sections of a patio or balcony. A stationary support is mounted on the floor and includes two foreshortened vertical supports rising only partially towards the ceiling section. A crossheader frame is movably retained between the two vertical supports. The crossheader frame is generally rectangularly shaped and the sides of the crossheader carry trolleys that run in tracks provided within the stationary support. In a first position, the crosshead frame is encased by the stationary support. In a second position, the crossheader frame extends from and frames an area between the stationary support and the ceiling. That area can be open or can be screened, as necessary. A window, consisting of a window pane and a window frame, is movably retained within the crossheader frame and the stationary support. In the first and second positions, the window is disposed within the stationary support. In a third position, the window is encased by the crossheader frame and therefore closes the framed area. The guardrail window assembly also includes a motor and a pulley drive system for moving the crossheader frame and the window sequentially through the first, second and third positions with respect to the stationary support.

21 Claims, 9 Drawing Sheets

FIG. 3A
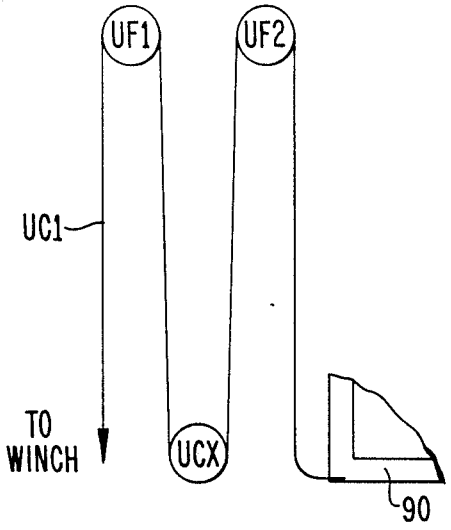
FIG. 4A
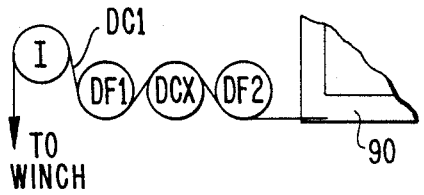
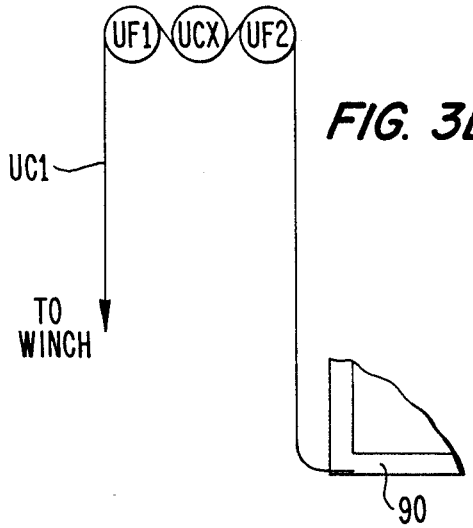
FIG. 3B
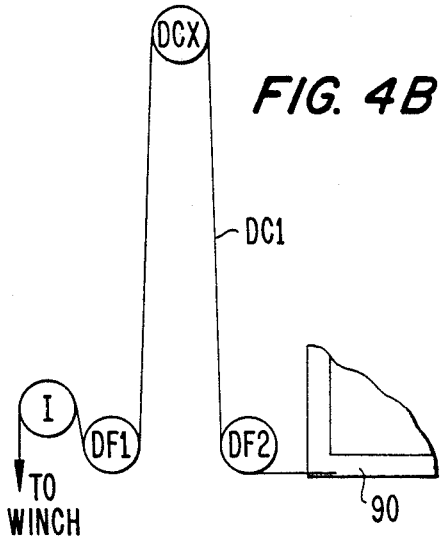
FIG. 4B
FIG. 3C
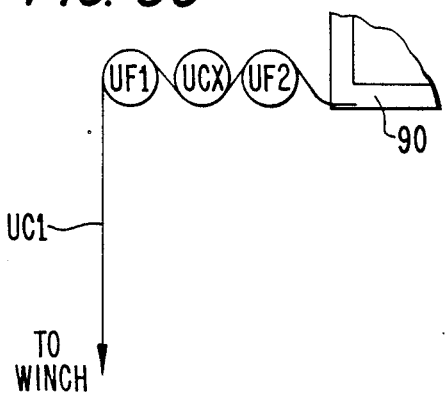
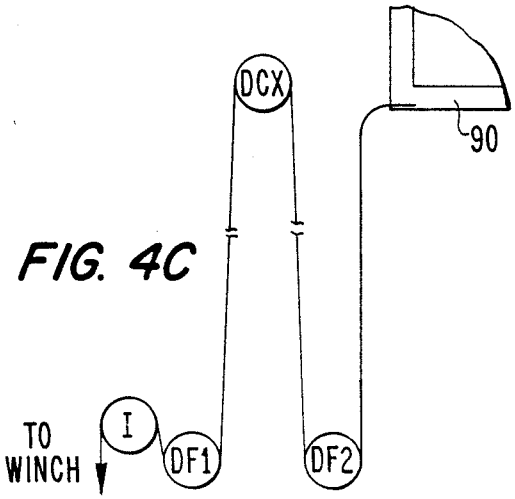
FIG. 4C

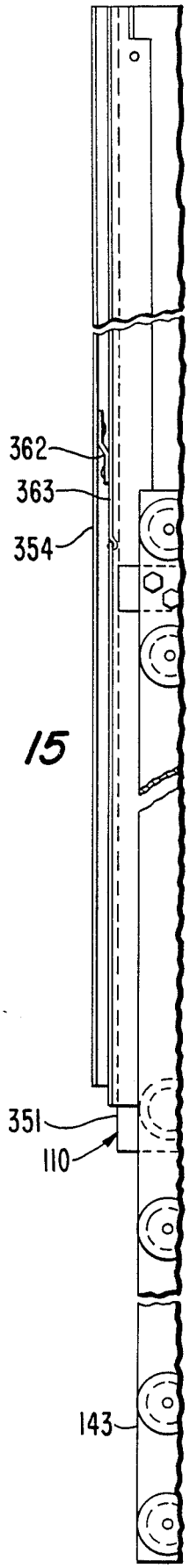
FIG. 15
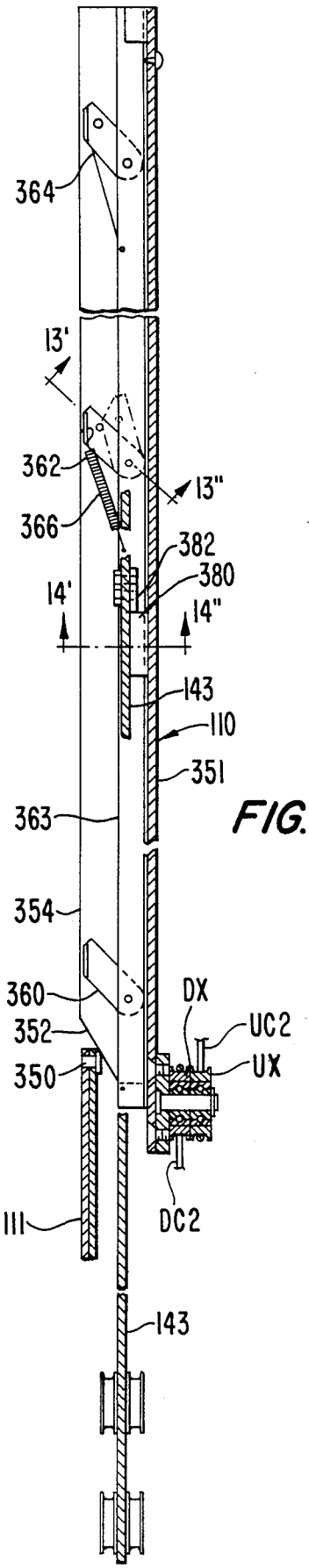
FIG. 12
FIG. 13
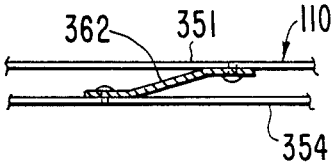
FIG. 14
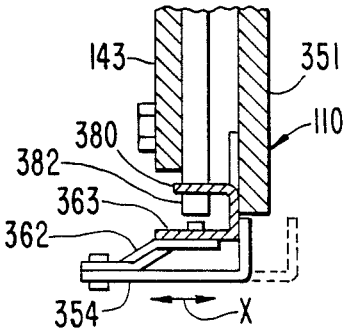

GUARDRAIL WINDOW ASSEMBLY WITH MOVABLE CROSSHEADER

BACKGROUND OF THE INVENTION

The present invention relates to a guardrail window assembly for a balcony or patio.

Some dwellings include a balcony or patio area that is covered by a ceiling or roof but is otherwise exposed to the outside environment. If this structure is a balcony, it typically includes a railing that is generally waist high. People living in the dwelling may wish to use the balcony or patio at times the weather is not particularly pleasant. The present invention permits individuals to enclose their patio or balcony thereby enabling better utilization of that space.

U.S. Pat. No. 4,735,023 to Posner describes a guardrail window assembly for balcony or patio wherein telescoping columns carry sets of windows to enclose a balcony or patio. In a compact shape, the structure forms an open air balcony or patio since these sets of windows are collapsed to the size of the railing. In a fully extended state, the telescoping columns carry window panes that completely enclose the balcony.

OBJECTS OF THE INVENTION

It is an object of the present invention to provide a guardrail window assembly having a movable crossheader or frame that initially rises from foreshortened columnar supports and locks into the ceiling before the window is raised within the crossheader frame.

It is another object of the present invention to provide a window assembly that is modular.

It is a further object of the present invention to provide a window assembly utilizing a single motor to drive the crossheader and the window sequentially up and down.

It is another object of the present invention to provide a positive upward and a positive downward drive system for the window assembly.

It is a further object of the present invention to provide drive systems which are a combination of double suspension and single suspension pulley mechanisms.

It is another object of the present invention to provide a continuous running track for the window that extends from floor to ceiling before the window begins moving from its bottom position to its top position enclosing the patio or balcony.

It is yet another object of the present invention to provide a trolley and running track system that is interleaved.

It is an additional object of the present invention to provide a plurality of window modules wherein each crossheader carries a screen such that by raising all the crossheaders on a patio or balcony the result is a screened in patio.

SUMMARY OF THE INVENTION

The guardrail window assembly includes a window sub-assembly movable between the floor and ceiling sections of a patio or balcony. A stationary support is mounted on the floor and includes two foreshortened vertical supports rising only partially towards the ceiling section. A crossheader frame is movably retained between the two vertical supports. The crossheader frame is generally rectangularly shaped and the sides of the crossheader carry trolleys that run in tracks provided within the stationary support. In a first position, the crossheader frame is encased by the stationary support. In a second position, the crossheader frame extends from and frames an area between the stationary support and the ceiling. That area can be open or can be screened, as necessary. A window, consisting of a window pane and a window frame, is movably retained within the crossheader frame and the stationary support. In the first and second positions, the window is disposed within the stationary support. In a third position, the window is encased by the crossheader frame and therefore closes the framed area. The guardrail window assembly also includes a motor and a pulley drive system for moving the crossheader frame and the window sequentially through the first, second and third positions with respect to the stationary support.

BRIEF DESCRIPTION OF THE DRAWINGS

Further objects and advantages of the present invention can be found in the detailed description of the preferred embodiment, when taken in conjunction with the accompanying drawings in which:

FIGS. 3A, 3B and 3C schematically illustrate the upward drive system and FIGS. 4A, 4B and 4C schematically illustrate the downward drive system;

FIG. 12 is a partial sectional view of the sealing plate and associated structures from the perspective of section line 12'—12" in FIG. 10 and generally from that same section line in FIG. 5;

FIG. 13 is view of the sealing plate and sealing plate support from the perspective of section line 13'—13" in FIG. 12;

FIG. 14 is a detailed, sectional view from the perspective of section line 14'—14" in FIG. 12; and FIG. 15 is a view of the sealing plate assembly, generally from the perspective of section line 15'—15" in FIG. 5.

DETAILED DESCRIPTION OF THE PREFERRED EMBODIMENT

The present invention relates to a guardrail window assembly.

Figure 1:
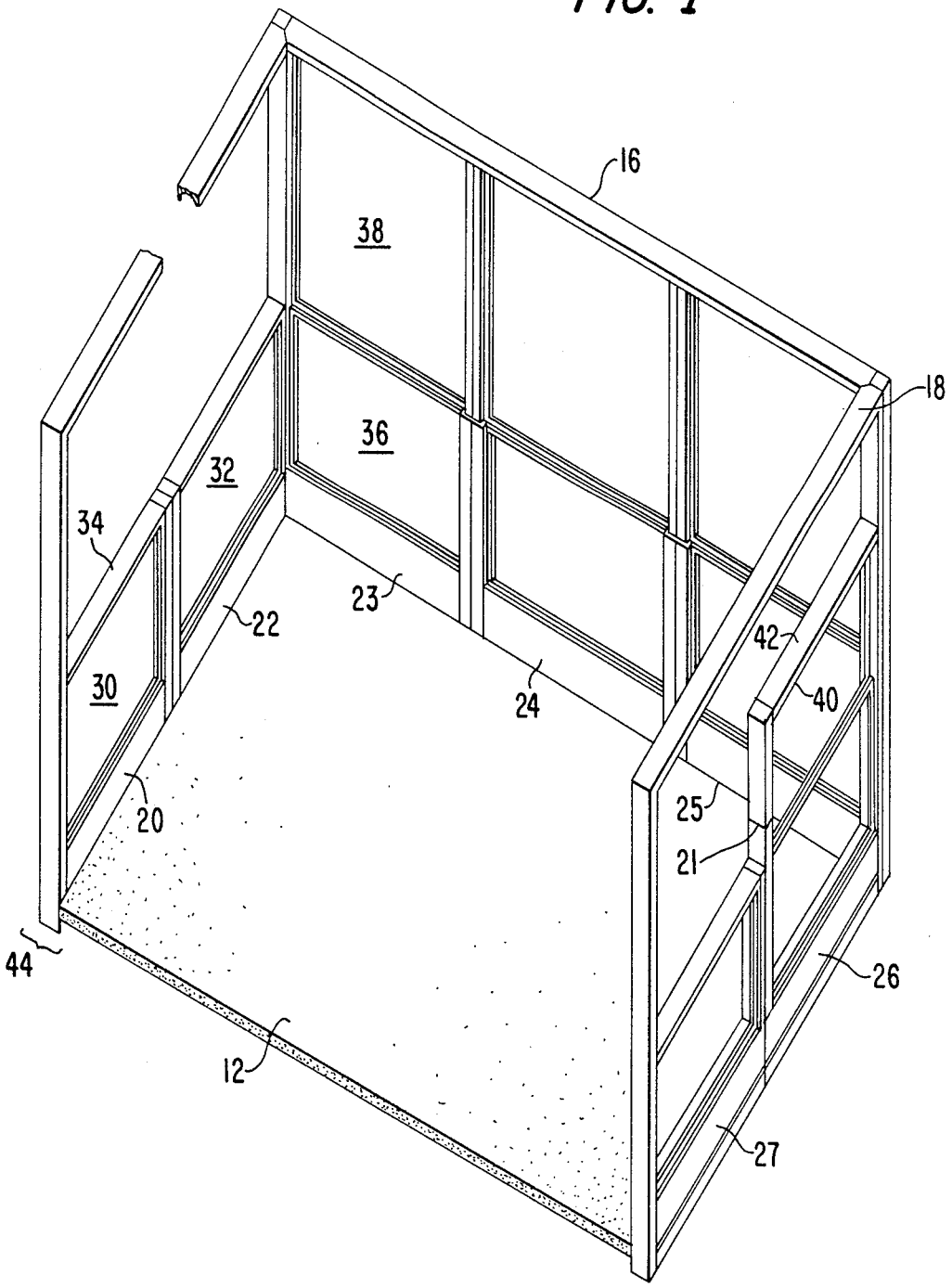
FIG. 1 illustrates a perspective plan view of a plurality of window assemblies mounted on a patio or balcony in accordance with the principles of the present invention.

FIG. 1 illustrates a perspective view of a balcony or patio having a floor 12 and a ceiling (not shown) to which is attached headers 14, 16 and 18. Affixed to floor 12 are window modules 20, 22, 23, 24, 25, 26 and 27. Each window module is a separate guardrail window assembly with its own motor and upward and downward drive systems. However, the motors of modules 20, 22, 23, 24, 25, 26 and 27 can be electrically linked such that all of the windows rise and fall together or groups of windows such as windows in modules 20 and 22 rise or fall together based upon the application of a control signal. In addition, each module includes a hand operated crank that can raise the windows when the motor is disabled.

FIG. 1 shows window modules 20 and 22 in a first position which is the most compact mode of the window assembly. These modules give the impression of a guardrail since region 30 is a glass wall and particularly is a fixed pane of glass and a movable pane of glass. Region 32 is similarly glass enclosed. Window module 20 includes handrail cap 34, as does window module 22. In contrast, window modules 23, 24 and 25 are in the third position wherein region 36 is glass enclosed, as is region 38. There is a single pane of glass in both of these regions. In contrast, window module 26 is in an intermediate position between the first and third positions. Particularly, crossheader frame 40 of window module 26 is in the process of being raised from the first position (the compact, collapsed position) to the second position wherein cap 42 locks into the underside of ceiling header 18. As shown with respect to ceiling header 14, the underside of the header is an inverted U shape such that headrail cap 34 snugly fits in the ceiling header. Since all of the window modules are substantially alike, only a single window module is discussed hereinafter. In a preferred embodiment, in the first or compact position, the height of window module from floor 12 is approximately 42 inches. However the total height of the window module, from its bottom plane to its top handrail, is approximately 46 inches. The window module extends below floor surface 12 as shown in region 44 of FIG. 1. This feature accounts for the lower apparent height of the handrail.

Figure 2:
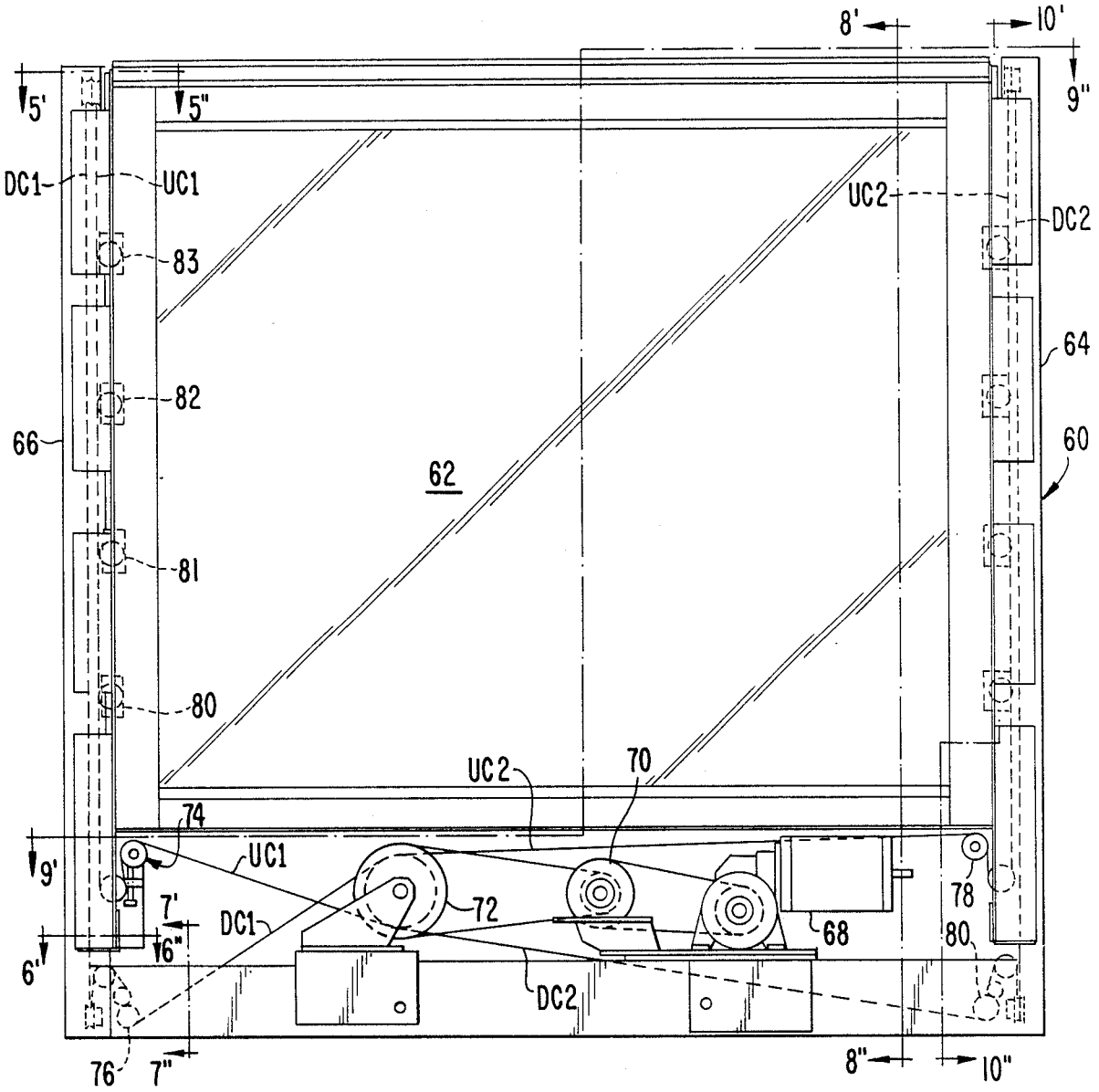
FIG. 2 illustrates a partial sectional view of a modular window assembly when the crossheader and the window are in a first position.

FIG. 2 illustrates a cross-sectional view of window module 60. In region 62, there is a double pane of window glass. The inner pane is fixed and the outer pane and associated frame moves within vertical support structures generally designed 64 and 66. The support structures are bolted or fixed to floor 12 in FIG. 1. In general, the movable window and its surrounding window frame is moved up and down with respect to vertical supports 64 and 66 by an upward and downward drive system that is powered by motor 68. A drive mechanism extends from motor 68 to transmission unit 70. Unit 70 provides power, in the form of torque, to winch 72. Winch 72 is part of the positive upward and positive downward drive mechanisms for left support structure 66 and right support structure 64. In the preferred embodiment, cables are utilized in the drive system. However, other mechanisms, such as chains or belts, can be utilized. The upward drive system for vertical support 66 includes up cable UC1. The positive downward drive system for that support includes down cable DC1. Power is delivered to the right hand vertical support 64 via up cable UC2 and down cable DC2.

Cable UC1 is kept taut by a buffer or spring loaded idler system 74. The details of this spring loaded idler are not described herein but a person of ordinary skill in the art could construct such a buffer to maintain the tension on the cables. Approximately five pounds of tension is placed on the cables by the buffers. Cable DC1 is associated with buffer 76; cable UC2 is associated with buffer 78 and cable DC2 is associated with buffer 80. As described hereinafter, the ends of all the cables UC1, UC2, DC1 and DC2 are respectively connected to the lower window frame corners such that crossheader frame is first raised from window module 60 and immediately thereafter the outer window is raised. Generally, the window frame has trolleys 80, 81 82 and 83 on its left hand side and a similar set of trolleys on its right hand side. As described later, these trolleys define tracking channels that cooperate with track runners such that the window frame and the associated window pane can be moved up and down by the upward and downward positive drive system. The drive system is positive because the tension on UC1, UC2 is increased when the window is being raised, while there is little or no tension on DC1, DC2. When the crossheader and then the window are being lowered, in addition to gravity assisting the downward drive, tension is increased on DC1, DC2 while UC1, UC2 is unwound from winch 72. This single motor system, driving a single winch, assures that both sides of the crossheader frame and subsequently the window frame are raised at the same time without binding.

FIGS. 3A, 3B, 3C and FIGS. 4A, 4B, 4C schematically illustrate the upward and downward drive systems. In the preferred embodiment, the drive systems are a combination of a double suspended and a single suspended pulley system. FIGS. 3A and 4A, respectively, show the upward drive and the downward drive system in the first position when the crossheader frame and the window are encased or bound by the vertical supports. Focusing on the upward drive system in FIG. 3A, two pulleys UF1 and UF2 are fixed in the upper region of each vertical support. Cable UC1 extends from the winch, runs towards the top of the vertical support around pulley UF1, runs down towards the bottom of the support and around pulley UCX which is attached to the crossheader frame and hence movable, returns back to the top region of the vertical support around fixed pulley UF2 and then runs back down to the bottom of the support and attaches to the bottom of window frame 90. Crossheader pulley UCX is part of a double suspension pulley system. To raise the crossheader, the force on cable UC1 need only be one-half of the weight of the crossheader. This assumes that only UC1 raises the window. In fact, the window is raised by two cables UC1 and UC1′ and, hence, the force is one-quarter the weight. However, cable UC1 must be moved twice the distance that the crossheader pulley UCX is raised. Position 2 of the window assembly is illustrated in FIGS. 3B and 4B. In position 2, the crossheader, and hence crossheader pulley UCX, has been raised. In the second position, window 90 is horizontally aligned with the permanently fixed window and the crossheader extends between the supports to the ceiling. To raise window 90, the winch must apply a force to cable UC1 substantially equal to the weight of window 90. The double cable system reduces this force by one-half as discussed above. Hence, window 90 is raised by a single suspension pulley system. After the system is in the second position (FIG. 3B), cable UC1 and window 90 move in equal proportions. FIGS. 3C and 4C show the third position of the window assembly at which both the crossheader frame and window 90 are in their highest positions, that is, adjacent the ceiling.

The downward drive system is illustrated in FIGS. 4A, 4B, 4C. Generally, the positive downward drive cable DC1 is wrapped oppositely as compared with upward drive cable UC1. In position 1, cable DC1 is first wound over idler wheel I, below first downward fixed pulley DF1, over downward drive crossheader frame pulley DCX, under fixed pulley DF2 and attached to the bottom of window frame 90. In the second position when the crossheader frame is completely raised, DCX is in the top region of the vertical support as compared with its position in the bottom region when the crossheader frame is completely lowered. In the third position when both the crossheader frame and window 90 are raised, the crossheader downward pulley DCX remains in the top region. To lower the system, gravity assists the positive down drive. Initially, window 90 is lowered into the vertical support region and then the crossheader frame is lowered. There is a positive drive in both the upward and downward directions because of the tension developed in UC1, UC2 during the upward stroke, and in DC1, DC2 during the downward stroke. Synchronous movement is achieved by providing the appropriate forces on upward cables UC1, UC2 and downward cables DC1, DC2 simultaneously by the use of a single winch and a single motor. This system will sequentially raise the crossheader frame first and then the window as long as the weight of the crossheader frame, and any items carried by the frame, does not exceed approximately twice the weight of the window. In the current embodiment of the invention, the crossheader weighs less than 30 pounds and the window weighs approximately 40 pounds.

Figure 5:
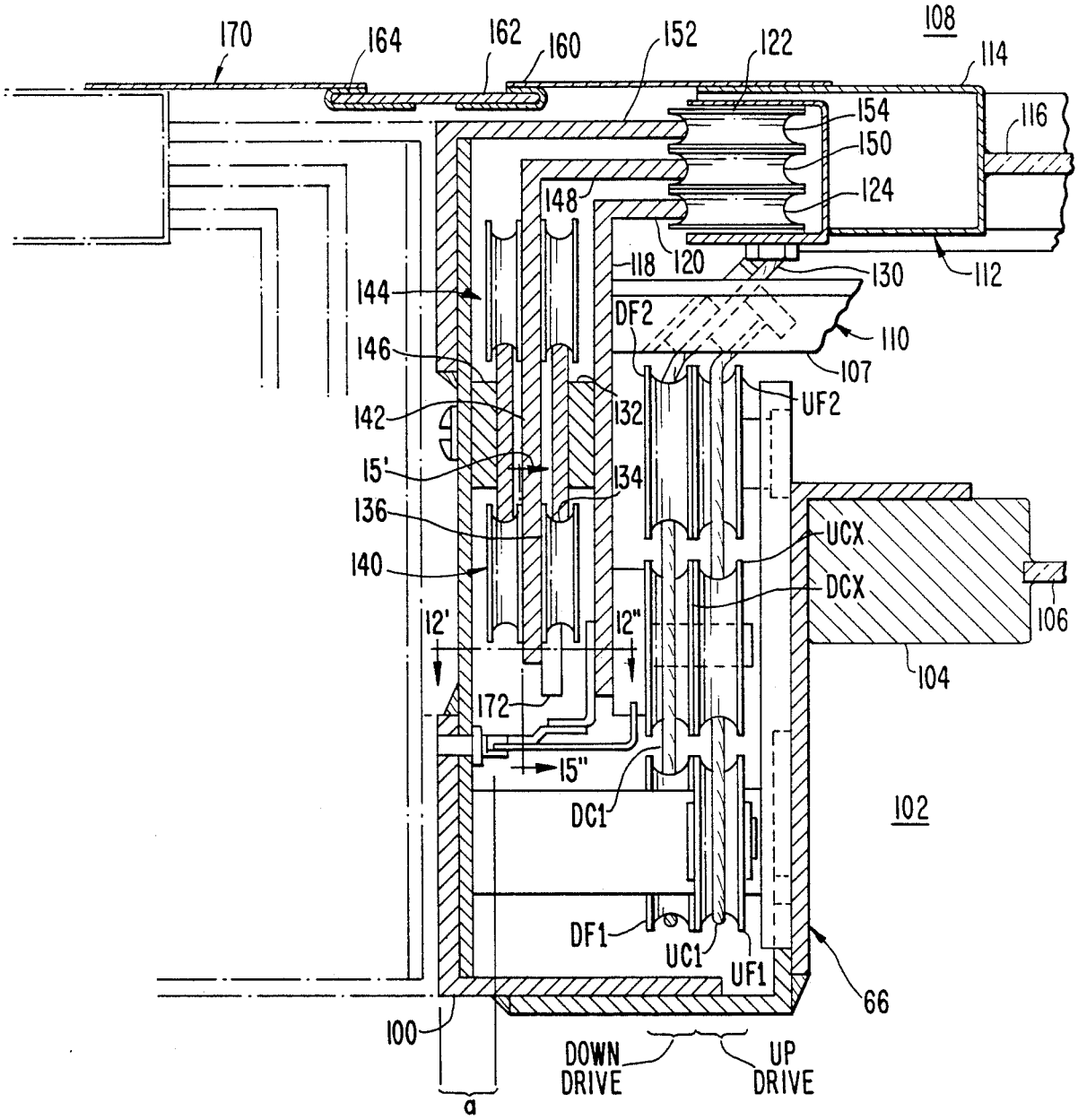
FIG. 5 is a cross-sectional view from the perspective of section 5'—5" in FIG. 2.

FIG. 5 shows a detailed, cross-sectional view of the upper region of one vertical support from the perspective of section line 5′—5″ in FIG. 2. As shown in FIG. 5, vertical support includes an outer wall 100 that is made of various wall sections that are welded together. Preferably, the entire support structure is made of rolled steel rather than made of component wall sections as shown herein. Near the inboard side 102 of support 66, a fixed window frame 104 holds fixed window 106. Moving away from inboard region 102 towards outboard region 108 (that is beyond the patio or balcony) is the bottom portion 107 of crossheader frame 110. Further outboard of crossheader frame 110 is window 112 that includes window frame 114 holding window pane 116. Crossheader frame 110 includes a side section 118. The side section generally corresponds to an inverted L wherein leg 120 defines a window track run for window frame trolley assembly 122. In other words, grooved wheel 124 is mounted on window frame 114 and defines a tracking channel that is complementary to a track insert that is embodied as leg 120 of crossheader section 118.

Crossheader 110 is connected to the drive system by DCX and UCX. DCX and UCX are mounted to the lower end of crossheader 110 as better shown in FIGS. 6 and 7. The downward drive cable DC1 is shaded darker as compared with the upward drive cable UC1 in FIGS. 5, 6 and 7. Cables DC1 and UC1 are attached to the bottom of window frame 114 by way of attachment mechanism 130 running below the lower frame section 107 of crossheader frame 110. Crossheader frame 110 moves within the vertical support via a trolley and track system. Generally, T shaped section 132 has the top of the T defining track runners, for example runner 134 that runs within trolley wheel 136. The trolley wheel is similar to a channel. Wheel 136 is part of a pair of wheels, generally designated as 140, that are attached to an intermediate support 142. Intermediate support 142 also has another set of wheels 144 that together define a pair of tracking channels, one for T section 146 attached to vertical support structure 100 and the other attached to T section 134 of crossheader frame 110. Intermediate support 142 is also an inverted L shape having a leg 148 that provides a track runner for trolley wheel 150 attached to window frame 114. An outboard section of vertical support 100 defines a track runner 152 for wheel 154 attached to window frame 114. The outboard surface of window frame 114 includes a seal support 160 within which is fixed a relatively flexible seal 162 that extends into loosely fitting seal channel 164 of the adjacent window assembly, generally designated as 170 and shown in phantom lines. The inverted L structures defined by the vertical support, the intermediate support and the crossheader frame provide an interleaved track and trolley system which is very stable in the horizontal plane. In combination with the movable window frame and the fixed tracks defined by the vertical supports, substantially all lateral movement of the intermediate supports and the crossheader frame in the horizontal plane is eliminated due to the interleaved track system.

As stated above, crossheader frame 110 is initially raised by the double suspension pulley action of UCX. There are a number of vertically displaced trolley wheels attached to intermediate support 142 and window frame 114, therefore the track runners of T section 132 move vertically with respect to the intermediate support trolleys, e.g., trolley 136, and track runner 120 moves with respect to trolley wheel 124 on window frame 114. When the crossheader frame reaches a certain point, generally half the height of the window module, a dog extending from crossheader frame 110, engages the underside of a stop 172 attached to intermediate support 142. Therefore, as crossheader frame 110 is thereafter raised, the intermediate support 142 is also raised. The top of an intermediate support is shown as item 21 in FIG. 1. This will provide a continuous track runner from floor to ceiling for the trolleys on window frame 114. The continuous track runner is made up of runner leg 152, attached to vertical support 110, runner leg 148 of intermediate support 142 extending from about one quarter of the height of the window module to about three-quarters of the height of the window module, and runner leg 120 of crossheader frame 110 extending from the upper region of the vertical support structure to the ceiling. Trolley assembly 122 mounted on window frame 114 utilizes the continuous track via trolley wheels 154, 150 and 124. The continuous track is generally coplanar with respect to window frame 114.

In a different embodiment, intermediate support 142 could be removed and T shaped section 132 of crossheader frame 110 could define vertical track runners that cooperate with trolleys fixed to vertical support 100.

Figure 6:
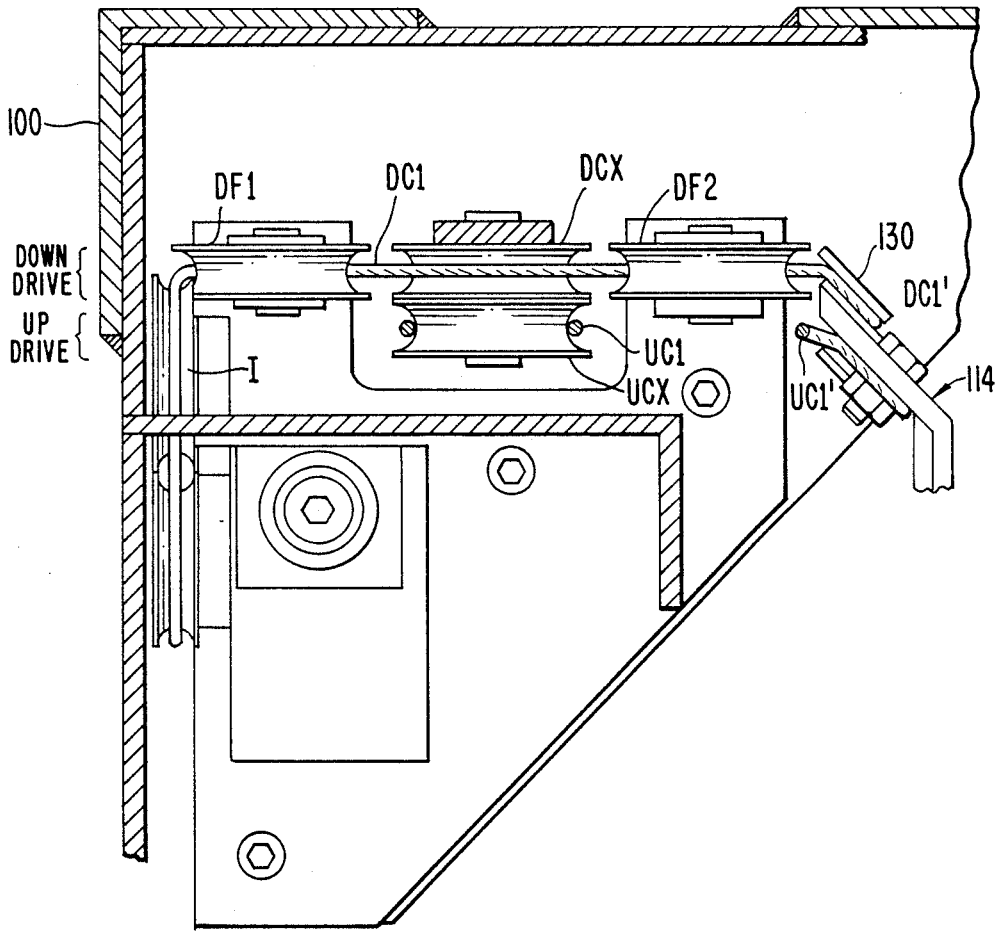
FIG. 6 is a sectional view from the perspective of 6'—6" in FIG. 2.
Figure 7:
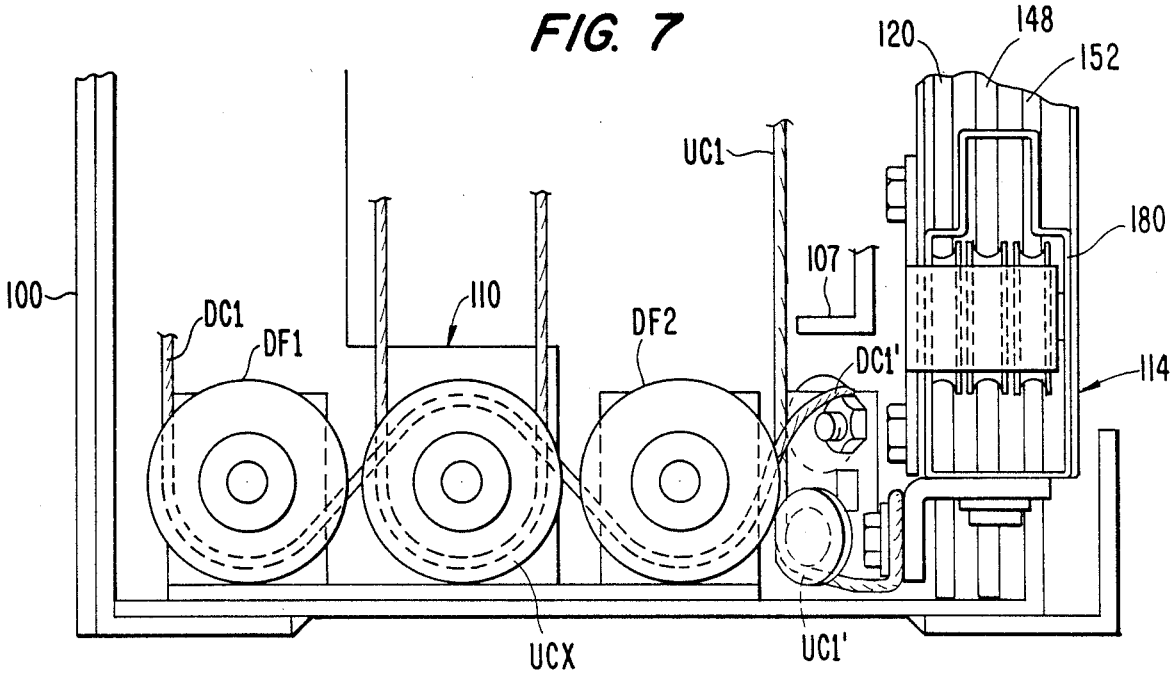
FIG. 7 is a sectional view from the perspective of section lines 7'—7" in FIG. 2.

FIG. 6 is a sectional view of a bottom region of vertical support 100 from the perspective of section line 6′—6″ in FIG. 2. FIG. 6 shows that the drive pulleys UCX, DCX for the crossheader frame are in the lower region of the vertical support when the window assembly is in position 1. Cable UC1 is wrapped under upward drive pulley UCX that is attached to the crossheader frame and downward drive pulley DCX is oppositely wrapped by DC1. FIG. 6 also shows attachment mechanism 130 connecting cable terminal end DC1′ and UC1′ to the bottom of window frame 114. On the other side of fixed, down drive pulley DF1 is idler wheel I for cable DC1. FIG. 7 is another sectional view of the lower region of vertical support 100 but from a different perspective, that is from the perspective of section line 7′—7″ in FIG. 2. FIG. 7 shows fixed pulleys DF1 and DF2 with drive pulley DCX attached to crossheader frame 110. Further, FIG. 7 shows upward drive cable UC1 leading from and returning to the upper region of vertical support 100 and the terminal end UC1′ attached to window frame 114. Terminal end DC1′ is also attached to the bottom of the window frame. Bottom section 107 of crossheader frame 110 is also schematically shown. A lower trolley 180 is mounted to window frame 114 and includes respective trolley wheels running on window frame tracks 120, 148 and 152. Vertical track runner 120 is part of crossheader frame 110; vertical track runner 148 is part of intermediate support 142; and vertical track runner 152 is part of the fixed vertical support 100.

Figure 8:
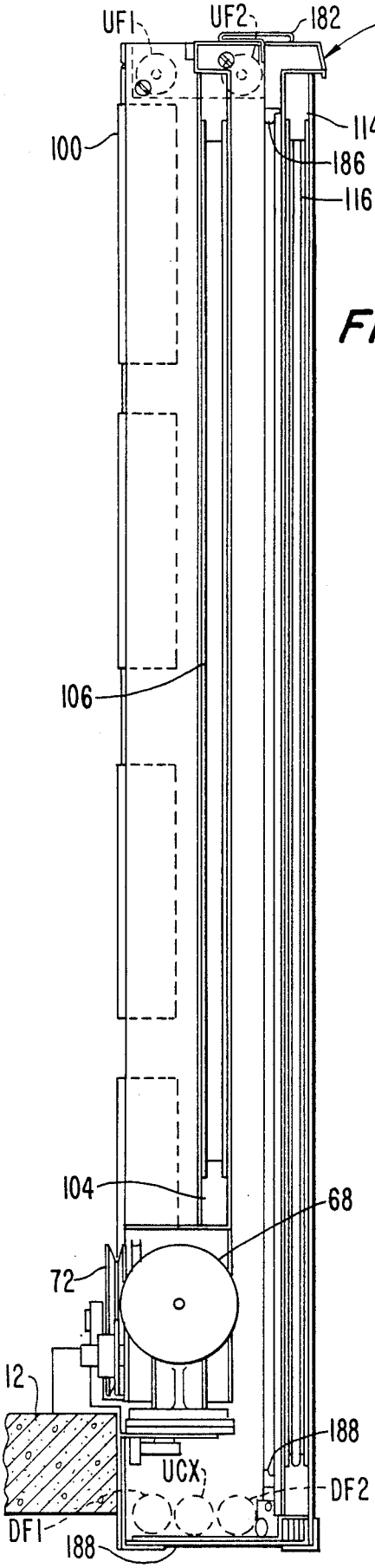
FIG. 8 is a sectional view of the window assembly in the first position from the perspective of section lines 8'—8" in FIG. 2.

FIG. 8 illustrates a sectional view of the window assembly in the first position from the perspective of section line 8′—8″ in FIG. 2. FIG. 8 shows crossheader frame 110 having an upper cap 182. Upper cap 182 fits snugly into the inverted U shape of the ceiling header 114 shown in FIG. 1. Upper frame section 184 of crossheader 110 is shaped as a right angle. Inboard of that angle is movable window frame 114 that supports window pane 116. Optionally, crossheader frame 110 may include a screen attached at inboard ledge 186 and 188 thereby enabling a person to "screen in" his patio or balcony rather than just enclose the balcony or patio with glass. Inboard fixed window 106 is shown in fixed frame 104. The depending aspect of the window module is shown in FIG. 8 wherein floor surface 12 is above bottom surface 188 of the module. In another embodiment, surface 188 may be on the floor. Winch 72 and motor 68 are shown in addition to up drive pulley UCX and down drive fixed pulleys DF1 and DF2. Up drive fixed pulleys UF1 and UF2 are disposed in the upper region of vertical support 100. Although FIG. 8 shows the inboard lower edge of the window module adjacent the vertical end face of the patio, the inboard surface of the module is not planar but is discontinuous. The resulting vertical through passages, defined by the patio end face and the discontinuous inboard planes of the window module, provide water drains for the patio. Three drains are provided.

Figure 9:
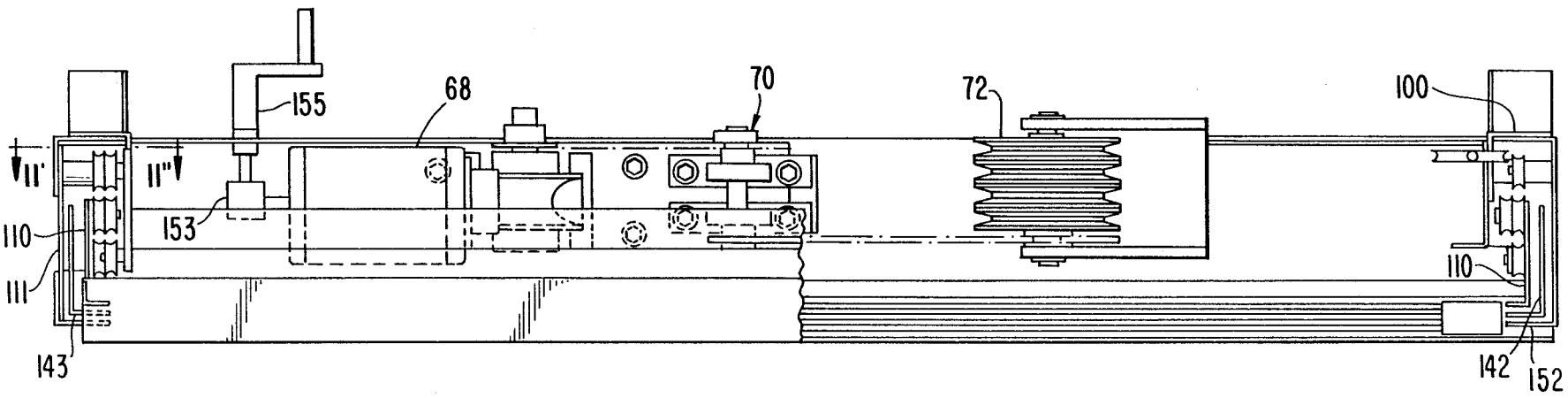
FIG. 9 is a sectional view from the perspective of 9'—9" in FIG. 2.

FIG. 9 is a sectional view of the window module from the perspective of section line 9′—9″ in FIG. 2. FIG. 9 shows winch 72, transmission unit 70 and motor 68. In the event that motor 68 is disabled, the module includes a right angle drive 153 attached to the stub shaft of the motor and a handwheel and crank 155. Vertical support 100, shown on the right hand side of FIG. 9, defines vertical track runner 152. Intermediate support 142 and crossheader frame 110 are also shown. On the left hand side of FIG. 9 is vertical support 111 having similar vertical track runners defined by the vertical support frame, an intermediate support 143 and the opposing side of crossheader frame 110.

Figure 10:
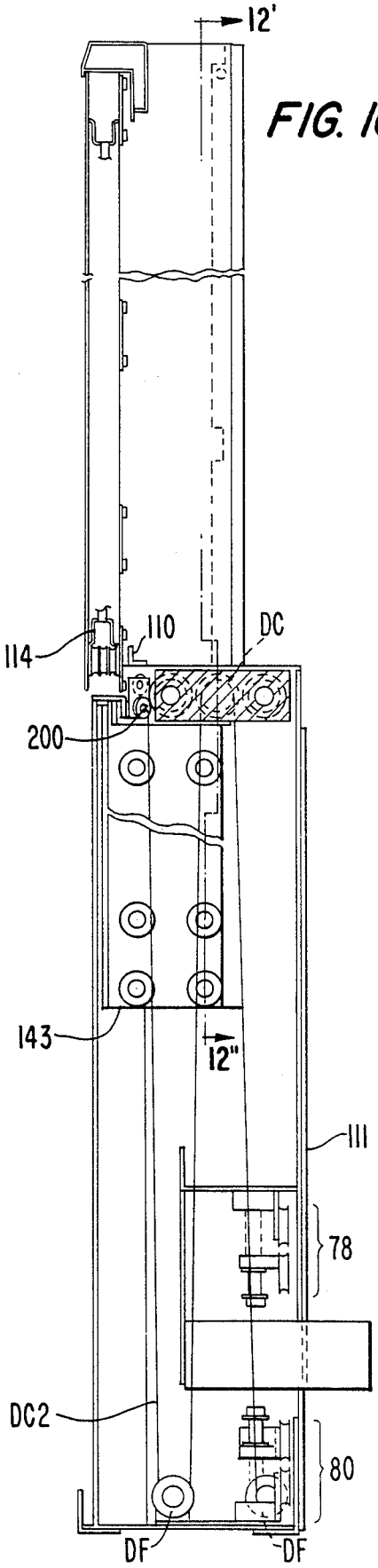
FIG. 10 is a sectional view of the window assembly in the third or fully extended position generally from the perspective of section line 10'—10" in FIG. 2.

FIG. 10 illustrates the window module in the fully extended position or in position 3. FIG. 10 is a sectional view generally from the perspective of section line 10′—10″ in FIG. 2. In FIG. 10, up cable UC2 spring buffer tensioning mechanism is shown in region 78 and the down drive cable DC2 buffer system is shown in region 80. Down drive cable DC2 is shown running from terminal end attachment 200, mounted on window frame 114 through a fixed down drive pulley DF back through a crossheader frame, down drive pulley DC and running back down to another down drive fixed pulley DF in the lower region of vertical support 111. The bottom region of an intermediate support 143 is also shown in FIG. 10.

Figure 11:
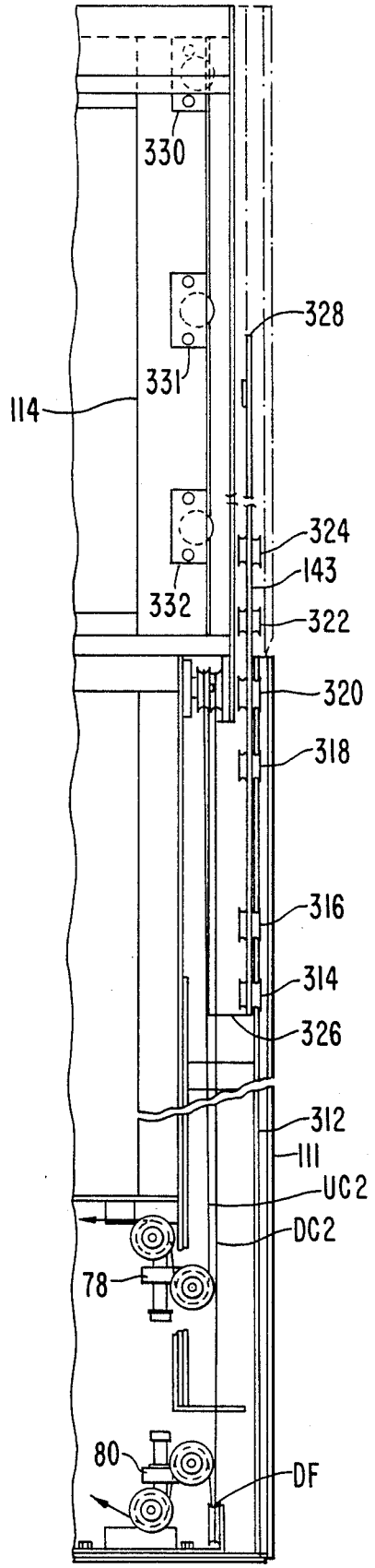
FIG. 11 is a partial cross-sectional view, generally from the perspective of section line 11'—11" in FIG. 9, illustrating the window assembly in the third position.

FIG. 11 is a partial cross-sectional view generally from the perspective of section line 11′—11″ in FIG. 9. FIG. 11 illustrates the window module in position 3. Vertical support 111 includes vertical track runner 312 that interacts with trolley wheels 314, 316, 318, and 320. These trolley wheels, in additional to wheels 322, 324 and others not shown, are mounted on intermediate support 143. Intermediate support 143 has a lower edge 326 and an upper edge only partially shown as 328. Window frame 114 has trolley wheel sets 330, 331, and 332 that coact with the vertical track runners generally co-planar to window frame 114 shown in the left hand side of FIG. 9. The routing of up and down cables UC2 and DC2 is shown.

FIG. 12 is a partial sectional view from the perspective of section line 12′—12″ in FIG. 10 or generally from section line 12′—12″ in FIG. 5. FIG. 12 illustrates crossheader 110 with down cable DC2 and up cable UC2 acting on pulleys DX and UX at the bottom of the crossheader. To the left of crossheader side plate 351 is intermediate support 143. To the left of intermediate support 143 is outer sidewall of vertical support 111. Near the top edge of vertical support 111 is a button 350 that rides against edge 352 of sealing plate 354. Sealing plate 354 is meant to move outboard towards the outer side of vertical support 111 a distance "a" shown in FIG. 5. This enables a cover or seal to be made between the outboard edge of either vertical support 100 in FIG. 5 or vertical support 111 in FIGS. 9 and 12 such that the inner workings of the support are not exposed to people on the balcony or patio. When the crossheader frame carries a screen, the laterally movable sealing plate seals the left and right crossheader frame sections to each other such that the completely raised crossheaders screen-in the patio or balcony. The sealing plate is pivotally held onto crossheader frame 110 by pivot brackets 360, 362, and 364. FIG. 13 is a cross-sectional view from the perspective of section line 13′—13″ in FIG. 12 and shows pivot piece 362 pivotally mounted onto crossheader frame 110 on one side and sealing plate 354 on the other side. Sealing plate 354 is forced outboard or towards the outside of vertical support 111 by a spring 366. Optionally, a second spring could be attached to pivot arm 364 as well as pivot arm 362.

The sealing plate works in the following fashion. As crossheader frame 110 is raised, eventually dog 380 engages stop 382 affixed to intermediate support 143. At that point, support 143 begins to rise along with crossheader frame 110. Concurrently, when crossheader frame 110 is moving, edge 352 of sealing plate 354 rides on button 350. When the angled portion of edge 352 is adjacent button 350, sealing plate 354 moves outboard due to the bias applied by spring 366 on one end of pivot arm 362. Since there are multiple pivot arms attaching sealing plate 354 to crossheader 110, the plate moves outboard or to the left of FIG. 12.

FIG. 14 is a detailed, cross-sectional view from the perspective of section line 14′—14″ in FIG. 12. In FIG. 14, sealing plate 354 moves in direction "x" as required by button 350 and by spring 366. Crossheader frame 110 has attached thereto a plate support 363. Plate support 363 includes a U shaped bent portion that is adapted to strike the bottom of stop 382. Therefore, leg 380 acts as the dog to actuate intermediate support 143. The sealing plate movement is shown in phantom lines in FIG. 14.

FIG. 15 shows another view of the seal plate which is a 90° rotation of FIG. 12. Seal plate 154 is shown attached to plate support 363 via pivot arm 362.

Another embodiment of the present invention utilizes dual or multiple crossheader frames and movable windows. This embodiment may be utilized for patio to ceiling distances of 9 feet or more. A dual system is necessary due to the limitation on height of the guardrail. In the dual system, a first crossheader frame would be raised to a height of about one-half of the distance between the top of the guardrail and the ceiling. Then, the second crossheader frame would be raised and locked into the ceiling. A first window would be raised within the first crossheader frame and than a second window would be raised in the second frame. The drive system could be duplicated. For example, the first crossheader frame could carry the three pulleys shown in FIG. 3A. These three pulleys would be the drive system for the second crossheader frame and second window. The first crossheader frame would be driven by the system described herein.

The claims appended hereto are meant to cover modifications within the true scope and spirit of the present invention. For example, the crossheader frame may carry a screen. Also, that frame may carry a decorative design such that the frame, when raised, provides an ornamental look to the exterior of the building. Similarly, the fixed window may have an ornamental design associated therewith. The drive systems could also be changed. Jackscrew drives, multiple motor systems and hydraulics may be used to raise crossheader frame from the vertical supports to the ceiling, thereby framing the open area therebetween, and then to raise the window utilizing the crossheader as a frame support structure. Other pulley systems may be utilized rather than the combination double and single suspension system. Also, reference to "a frame" in the claims refers to a single, dual or multiple crossheader frame and window system.

What is claimed is:

1. A guardrail window assembly with a window subassembly movable between floor and ceiling sections of a patio or balcony, the guardrail window assembly comprising:

a stationary support having two foreshortened vertical supports rising from said floor only partially towards said ceiling section;

a frame movably retained between said two vertical supports, said frame encased by said stationary support in a first position, said frame extending from and framing an area between said stationary support and said ceiling in a second position;

a window movably retained within said frame and said stationary support, said window disposed within said stationary support in said first and second positions, said window encased by said frame and thereby closing said framed area in a third position; and, means for sequentially moving said frame and said window through said first, second and third positions with respect to said stationary support.

2. A guardrail window assembly as claimed in claim 1 wherein said means for sequentially moving includes an upward drive means for sequentially moving said frame and said window upward through said first, second and third positions, and includes a downward drive means for moving said frame and window sequentially through said third, second and first positions.

3. A guardrail window assembly as claimed in claim 2 wherein said upward and downward drive means include a combination single suspended and double suspended pulley mechanisms.

4. A guardrail window assembly as claimed in claim 3 wherein said upward and downward drive means is driven by a single motor.

5. A guardrail window assembly as claimed in claim 1 wherein said frame is a crossheader that is generally rectangularly shaped, an upper crossheader section abutting said ceiling in said second position.

6. A guardrail window assembly as claimed in claim 5 wherein said crossheader includes opposing side sections that define tracking channels and said two foreshortened vertical supports each define a channel insert complementary to the respective tracking channel.

7. A guardrail window assembly as claimed in claim 6 wherein said tracking channels are trolleys.

8. A guardrail window assembly as claimed in claim 7 wherein said means for sequentially moving includes a single suspended and a double suspended pulley mechanism.

9. A guardrail window assembly as claimed in claim 8 wherein crossheader is moved through said positions by said double suspended pulley mechanism.

10. A guardrail window assembly as claimed in claim 1 wherein said window includes a pane and window frame having opposing side sections that define tracking channels and said two foreshortened vertical supports and opposing frame side sections both include channel inserts complementary to the respective tracking channel.

11. A guardrail window assembly as claimed in claim 10 wherein said tracking channels on said window are trolleys and said channel inserts define a substantially continuous vertical track when said frame is in said second position for said window.

12. A guardrail window assembly as claimed in claim 11 wherein said means for sequentially moving includes a single suspended and a double suspended pulley mechanism.

13. A guardrail window assembly as claimed in claim 12 wherein said window and window frame is moved through said positions by said single suspended pulley mechanism.

14. A guardrail window assembly as claimed in claim 11 wherein said trolleys are window frame trolleys and said complementary channel inserts are vertical window frame tracks on which said window frame trolleys run, and wherein said frame, movable with respect to said window and window frame, is a crossheader that is generally rectangularly shaped and has opposing side sections on which are mounted crossheader trolleys, and said two foreshortened vertical supports each define a vertical crossheader track that is complementary to respective crossheader trolleys such that the crossheader trolleys run thereon, said crossheader also defining additional window frame tracks and said window frame having additional window frame trolleys which run on said additional window frame tracks.

15. A guardrail window assembly as claimed in claim 14 wherein said means for sequentially moving includes a single suspended and a double suspended pulley mechanisms that are driven by a motor, said crossheader is moved through said positions by said double suspended pulley mechanism, and said window frame is moved through said positions by said single suspended pulley system, said pulley mechanisms located in said two foreshortened vertical supports.

16. A guardrail window assembly as claimed in claim 14 wherein said window frame tracks and said additional window frame tracks are generally coplanar with said window frame and said crossheader tracks are normal thereto.

17. A guardrail window assembly as claimed in claim 11 including an intermediate support movably disposed in each foreshortened vertical support, wherein said trolleys are window frame trolleys and the complementary channel inserts are vertical window frame tracks on which said window frame trolleys run, and wherein said frame is a crossheader that is generally rectangularly shaped and has opposing side sections which define vertical crossheader tracks, each intermediate support having a further vertical window frame track on which rides further window frame trolleys mounted on said window frame, said intermediate support having crossheader trolleys mounted thereon which ride on said vertical crossheader tracks, and each intermediate support having intermediate support trolleys mounted thereon, said foreshortened vertical supports including intermediate vertical tracks complementary to said intermediate support trolleys such that said intermediate support trolleys run thereon, and means for moving said intermediate support to an intermediate position spanning both a portion of said crossheader and said vertical support when said crossheader is in said second position such that said window frame has a continuous track for said window trolleys for movement of said window frame from said second position to said third position.

18. A guardrail window assembly as claimed in claim 17 wherein said further window tracks are generally coplanar with said window frame and said intermediate support trolleys, said intermediate tracks, crossheader trolleys and crossheader tracks are normal thereto.

19. A guardrail window assembly as claimed in claim 18 wherein said crossheader tracks are disposed on said crossheader such that said crossheader trolleys run thereon.

20. A guardrail window assembly as claimed in claim 1 including two intermediate supports, a separate intermediate support movably retained in each of said two foreshortened vertical supports, means for moving said intermediate supports to an intermediate position spanning both said vertical support and said frame while said frame is in said second position; said two vertical supports, said intermediate supports and said frame defining a continuous floor to ceiling tracking means for said window when said frame is in said second position, and said window having complementary tracking means thereby permitting said window to be moved from said second position to said third position.

21. A guardrail window assembly as claimed in claim 1 including two vertically oriented, laterally movable seal plate means for bridging the gap between left and right side planes of said vertical supports and left and right side sections of said frame when in said second position.

* * * * *